United States Patent [19]

Savage

[11] 3,987,691

[45] Oct. 26, 1976

[54] EXTENSIBLE NON-CRANKING WRENCH

[76] Inventor: Bobbie O. Savage, 901 Gladeview Drive, Farmington, N. Mex. 87401

[22] Filed: Nov. 13, 1975

[21] Appl. No.: 631,609

[52] U.S. Cl. ..... 81/57.3

[51] Int. Cl.[2] ..... B25B 17/00

[58] Field of Search..... 81/57.3, 57.26, 57.27, 81/57.28

[56] References Cited

UNITED STATES PATENTS

| | | | |
|---|---|---|---|
| 2,501,217 | 3/1950 | Hawn | 81/57.27 |
| 2,830,479 | 4/1958 | Finn | 81/57.3 |

*Primary Examiner*—James L. Jones, Jr.
*Attorney, Agent, or Firm*—Karl W. Flocks

[57] ABSTRACT

A wrench suitable for use in extremely close quarters where space for cranking is completely lacking and use of power driver is impossible comprising an elongate housing and a nut or bolt heat receiving wrench socket rotatably secured within the housing at each end thereof. Each of the wrench sockets is provided with gear teeth integral with and extending around the periphery of the sockets. One or more gear members forming a gear train is disposed within the elongate housing and extend along the length of the wrench to provide a driving relationship between the gear teeth of the wrench sockets. One or more additional wrench members is attached to and drivingly interconnected to the first mentioned wrench to penetrate any labyrinth or tortuous path to install or remove a nut or bolt without cranking.

11 Claims, 12 Drawing Figures

EXTENSIBLE NON-CRANKING WRENCH

BACKGROUND OF THE INVENTION

1. Field of the Invention

The present invention relates to a tool which is used to apply a rotary force to a nut or bolt for purposes of installing or removing the said nut or bolt. More particularly, tools which are of the type and construction of the present invention are believed most likely to be found in Class 81/57.3.

2.Description of the Prior Art

Exemplifying the prior art devices appearing to be most relevant to the construction disclosed herein is U.S. Pat. No. 2,830,479. With the prior art in mind, it is seen that the broad concept of providing a remote driver to apply torque to a nut or bolt through a gear train or chain and sprocket transmission to a nut or bolt socket is known. The prior art further has recognized the technique of connecting several wrench units together to extend the wrench assembly and provide drive between remote ends through the intermediary of gear trains between opposite ends of each wrench unit. Further, with respect to the technique of connecting and securing several wrench units together at different angles of intersection, the prior art shows the formation of radial splines on adjacent side faces of wrench units, establishing the desired angle of interaction of wrench units and clamping same securely by wing nuts and bolts.

SUMMARY OF THE INVENTION

The present invention relates to a new and improved tool for applying torque to nut and bolt elements in relatively inaccessible or difficult-to-reach locations to install or remove such elements. The present invention achieves its objectives by providing spaced-apart drive sockets in an elongate housing wherein a power driver such as a pneumatic gun is applied to one socket having power transmission members geared thereto to drive a remotely driven socket.

OBJECTS OF THE INVENTION

Consistent with the summary of the invention set forth above, it is an object of the present invention to provide a new and improved wrench to reach a nut or bolt situated in very close quarters where even the very least amount of cranking space is unavailable and to apply torque to such a nut or bolt to install or remove same.

It is another object of the present invention to provide a new and improved wrench assembly wherein two or more wrench units may be quickly assembled or disassembled in an expeditious manner.

It is still another object of the present invention to provide a new and improved wrench assembly including coupling means for readily adapting to different size sockets of various wrench units and quickly interconnecting same as required.

It is yet another object of the present invention to provide a new and improved wrench assembly wherein the coupling means and any socket to which it may be adapted will be in positive locking relationship regardless of direction of rotation of the drive or driven socket.

It is yet a further object of the present invention to provide a new and improved wrench assembly of the non-cranking type in which the nut or bolt driving socket be tilted from the plane of the wrench body or housing to further adapt itself to a difficult or otherwise inaccessible location.

DETAILED DESCRIPTION OF THE INVENTION

Figures 1, 2, 3, 4, 5:
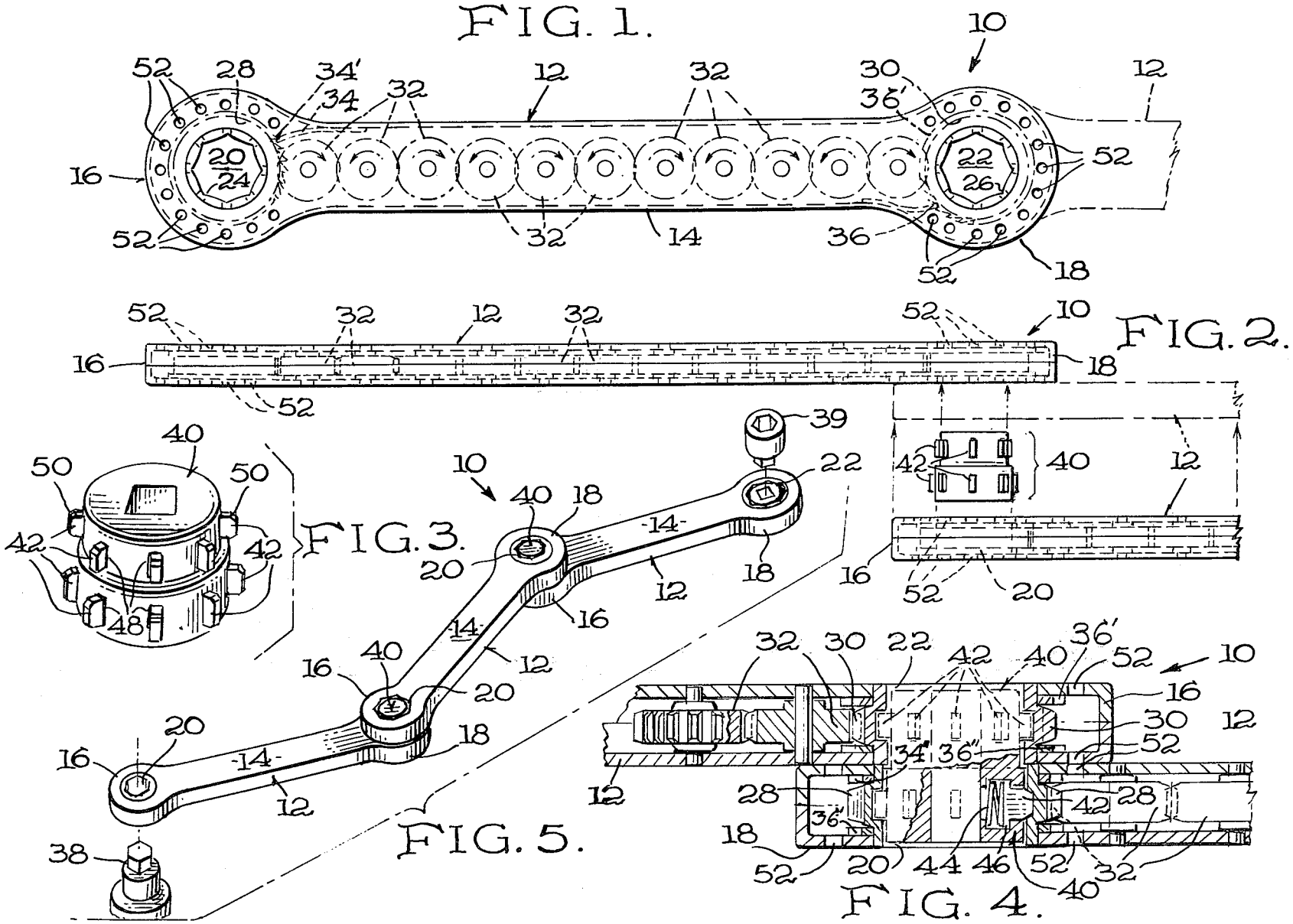
FIG. 1 is a plan view of a wrench unit showing a pair of geared drive sockets drivingly connected with a plurality of power transmitting pinions.
FIG. 2 shows a side elevational view of the wrench unit of FIG. 1 forming part of an exploded view with parts associated therewith for assembly.
FIG. 3 shows an enlarged view in perspective of an adapter element for coupling a pair of wrench units.
FIG. 4 shows a fragmentary sectional view in elevation of the parts of FIG. 2 in assembly on an enlarged scale.
FIG. 5 shows a view in perspective of a wrench assembly according to the present invention with socket and power tool spaced from opposite ends thereof.

Referring now in detail to FIGS. 1–5, the reader will readily appreciate that one form of the present invention is embodied in a wrench assembly 10 comprising one or more wrench units 12. Each wrench unit 12 is formed with a hollow elongate body or housing 14 and enlarged heads 16, 18 at opposite ends thereof. Rotatable nut or bolt sockets 20, 22 are disposed in the respective enlarged heads 16, 18. Each socket 20, 22 is formed with fluted or polygonal walls 24, 26 internally thereof and gear teeth 28, 30 on the outer periphery thereof. In the space between gears 28, 30 of sockets 20, 22 a plurality of pinion gears 32 are provided in driving engagement to transmit rotary motion to or from each of sockets 20, 22 to the other in the direction indicated by arrows in FIG. 1 as determined by setting adjustable ratchets 34, 36 which may be of any conventional structure to select direction of rotation of sockets 20, 22 by being selectively adjustable into engagement with either ratchet wheels 34′, 36′ having teeth for locking rotation in a first direction or ratchet wheels 34″, 36″ having teeth for locking rotation in a direction opposite to the first direction.

As indicated in FIG. 5, a driver 38 of an air driven wrench may be applied to one socket 20 to thereby rotate socket 22 by way of pinion gears 32. Socket 22 as described thus far may be applied to a nut or bolt to turn same or may be drivingly connected to an additional wrench unit 12 such as illustrated in FIGS. 4 and 5. Also, an adapter nut socket 39 may be inserted in socket 22. To facilitate driving connection between wrench units 12, a two-step adapter coupling plug 40 of suitable thickness is inserted in adjacent sockets to two links of a wrench chain to be formed. Adapter plug 40 is provided with a plurality of radial projection 42 for locking engagement with crevices or corners of fluted or polygonal walls 24, 26 of sockets 20, 22 of wrench units 12 to be connected. Each projection 42 is resiliently urged radially outwardly into engagement with a crevice or corner by a spring 44 behind a flange portion 46 of projection 42. It is clear that radial ports 48 are provided on the periphery of plug 40 to accommodate reciprocation of projections 42. To facilitate insertion and/or removal of plugs 40 bevel shoulders 50 are formed at opposite ends of projections 42. By reason of the fact that adapter plug 40 is provided with resiliently biased projections 42, any number of wrench units 12 having various different size sockets 20, 22 within a given range may be readily coupled together therewith.

To facilitate connecting various wrench units 12 to follow or penetrate a tortuous or labyrinth path to rotate a nut or bolt, the heads 16, 18 of each wrench unit are provided with a plurality of perforations 52 in a generally circumferential pattern. In assembling two such wrench units 12 together the units 12 are placed together at a desired angle and a lock pin is inserted through any one or more perforations 52 of one wrench unit 12 in registration with perforations 52 of a wrench unit 12 to be coupled together therewith. The pin to be inserted through registered perforations may be made integral with or separate from the various wrench units. While it is clear that various wrench units will have enlarged heads 16, 18 of different sizes, it is clear that the perforations of each wrench unit 12 must be of the same size and formed on circular centerlines having equal length radii.

Figures 6, 7, 8, 9, 10, 11, 12:
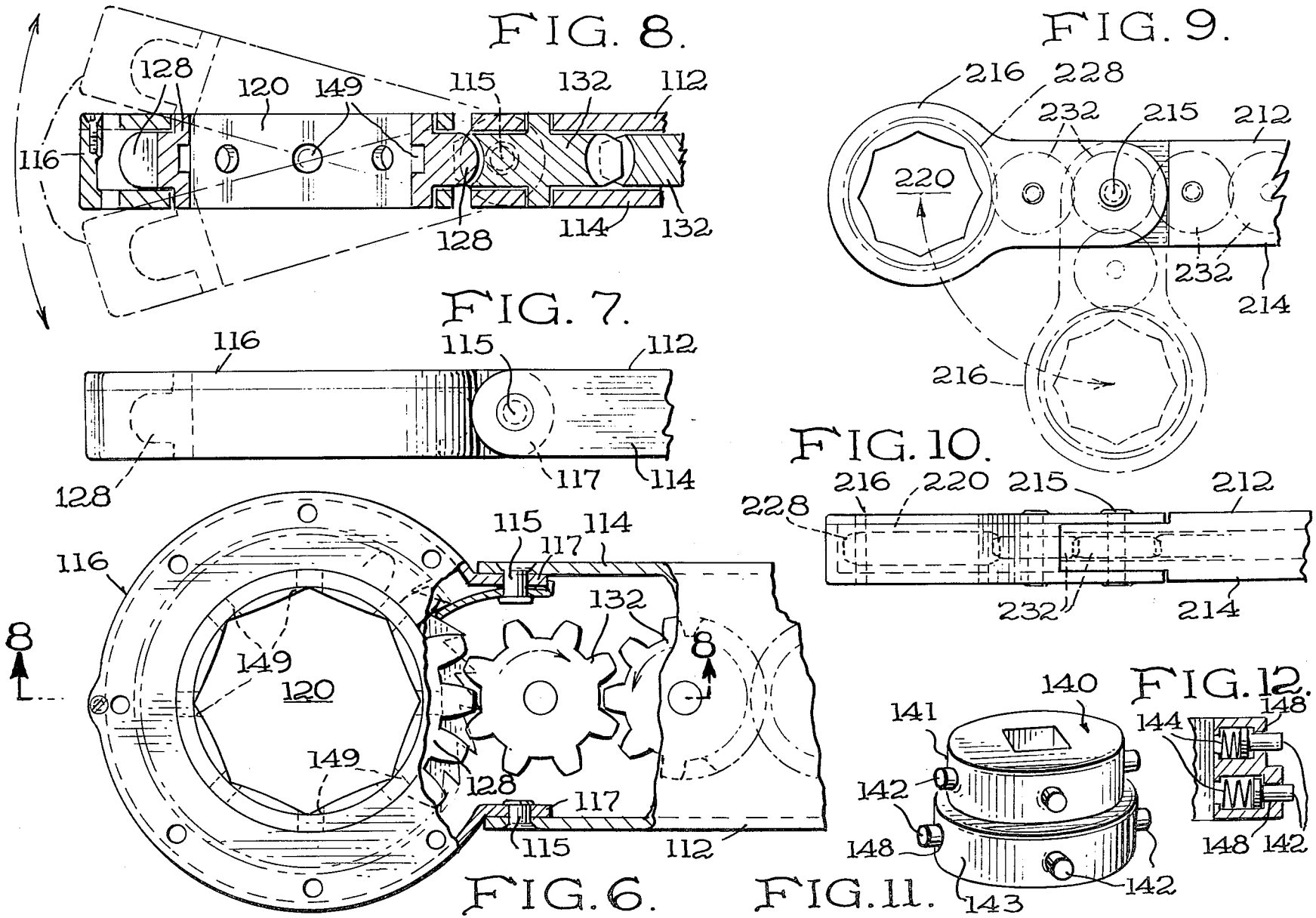
FIG. 6 shows a plan view of an alternative embodiment of the present invention with portions thereof broken away for clarity.
FIG. 7 is a side elevational view of FIG. 6.
FIG. 8 is a sectional view in elevation taken along section 8—8 in FIG. 6.
FIG. 9 shows a plan view of a further alternative embodiment of the present invention.
FIG. 10 is a side elevational view of FIG. 9.
FIG. 11 shows a view in perspective of an adapter element used in the assembly of FIG. 8.
FIG. 12 is a fragmentary elevational view of the adapter element of FIG. 11 with portions broken away for clarity.

An alternative form of the present invention is illustrated in FIGS. 6–8 in which wrench unit 112 includes at least one enlarged head 116 pivotally secured to a body or housing 114 by pivot pins 115 extending through opposite flange extensions 117 from enlarged head 116 and through housing 114. With the pivotal arrangement of enlarged head 116 of wrench unit 112 as described, nuts or bolts may be reached by socket 120 to rotate same even when such nuts or bolts are slightly out of the general plane of wrench housing 114 merely by tilting or flexing enlarged head 116 in the appropriate directions as indicated by the arrow in FIG. 8.

To insure continuous driving relationship of socket 120 gear 128 formed on the periphery of socket 120 is formed with adequate axial width and/or of generally conical cross-section so that even when socket 120 is tilted out of the plane of wrench housing 114 pinion 132 remains in mesh therewith.

To facilitate driving connection between wrench units 112 adapter coupling plug 140 as illustrated in FIGS. 11 and 12, is provided with stepped or non-stepped plug portions 141, 143 for mating relationship with sockets 120 or the like of wrench units 112 to be coupled together. Radially reciprocating plungers 142 which are generally cylindrical are resiliently urged outwardly of ports 148 by springs 144 for purposes of engaging with plunger-receiving radial bores 149 formed in sockets 120. With plungers 142 urged into bores 149, coupling plug 140 will lock the socket 120 of one wrench unit 112 in driving engagement with that of another wrench unit.

An additional alternative embodiment of the present invention is illustrated in FIGS. 9 and 10 in which wrench unit 212 includes a body or housing 214 with an enlarged socket head 216 pivotally secured to one end thereof by pivot pins 215 for tilting within the plane in the direction of the arrow in FIG. 9 to reach relatively inaccessible nuts or bolts. As in the earlier described embodiments of the wrench according to the present invention, wrench unit 212 includes a gear driven socket 220 with external gear 228 which is rotated by pinion 232 of a gear train.

From the above description of various embodiments of the disclosed invention, it is believed to be amply clear that a torque applying wrench requiring no cranking is provided, also one that is extensible to follow and penetrate any tortuous or labyrinth path, where relatively inaccessible a nut or bolt may be rotated by power means at a convenient location spaced therefrom. It is also clear that the present invention as described provides a quick and convenient coupling arrangement which may be adapted to various sizes of wrench sockets and different angles of connecting units. It is further clear that the present invention provides an extensible wrench assembly with mechanically flexible ends which may be driven by remote power means.

It will be obvious to those skilled in the art that various changes may be made without departing from the spirit of the invention and the invention is not to be considered limited to what is shown in the drawings and described in the specification.

What is claimed is:

1. An extensible non-cranking wrench for use in torque nuts or bolts in extremely close quarters where space for cranking is completely lacking and room for a power driver in unavailable, said wrench comprising an elongate body having rotatable sockets at opposite ends thereof, gear teeth formed on the external periphery of each of said sockets, a gear train including one or more idler pinions in driving engagement with the gear teeth of said sockets, adjustable ratchet means for selectively locking said sockets for rotation in one or the other direction, a plurality of perforations arranged around each of said sockets and means in one of said perforations for locking said wrench to a like wrench at a selected angle to extend into a tortuous or labyrinth path, said sockets being of such size and shape as to include non-circular wall portions to torque nuts and/or bolts, said sockets further being of such shape as to receive and cooperate with coupling means for attachment of sockets, and/or other wrench members thereto.

2. The wrench as defined in claim 1, wherein at least one of said sockets is pivotally secured to one end thereof for tilting movement to reach a nut or bolt.

3. The wrench as defined in claim 2, wherein said one of said sockets is secured to said one end of said wrench for tilting movement out of the plane of said elongate body.

4. The wrench as defined in claim 3, wherein said gear teeth of said one of said sockets is of such axial width as to remain in driving relationship with a pinion of said gear train even when said one of said sockets is tilted out of the plane of said elongate body.

5. The wrench as defined in claim 2, wherein said one of said sockets is secured to said one end of said wrench for tilting movement within the plane of said elongate body.

6. The wrench as defined in claim 1, wherein a first portion of a stepped adapter coupler plug is disposed in at least one of said sockets and locked together for rotation therewith.

7. The wrench as defined in claim 6, wherein radial projections are provided in the radial periphery of said plug for locking engagement with said one of said sockets.

8. The wrench as defined in claim 7, wherein said radial projections are resiliently biased into engagement with said one of said sockets by means extending radially inwardly of said projections.

9. The wrench as defined in claim 8, wherein said projections include bevel shoulders at opposite ends thereof to facilitate assembly and disassembly thereof.

10. The wrench as defined in claim 8, wherein said projections are generally cylindrical and said one of said sockets includes a plurality of radial bores in which said projections are received in assembly to lock said socket for rotation with said plug.

11. The wrench as defined in claim 8 wherein a second portion of said adapter coupler plug is disposed in a socket of a second wrench similar in construction to said first wrench whereby driving relationship is established between all sockets of said wrenches in assembly.

* * * * *

UNITED STATES PATENT OFFICE

CERTIFICATE OF CORRECTION

Patent No. 3,987,691 Dated October 26, 1976

Inventor(s) BOBIE O. SAVAGE

It is certified that error appears in the above-identified patent and that said Letters Patent are hereby corrected as shown below:

Column 4, line 32, "in" should read --is--.

Signed and Sealed this twelfth Day of July 1977

[SEAL]

*Attest:*

RUTH C. MASON
*Attesting Officer*

C. MARSHALL DANN
*Commissioner of Patents and Trademarks*